US010519789B2

(12) United States Patent
Kwak

(10) Patent No.: US 10,519,789 B2
(45) Date of Patent: Dec. 31, 2019

(54) LOCKING SPACER FOR ROTOR BLADE

(71) Applicant: DOOSAN HEAVY INDUSTRIES & CONSTRUCTION CO., LTD., Changwon-si, Gyeongsangnam-do (KR)

(72) Inventor: Joohwan Kwak, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 109 days.

(21) Appl. No.: 15/812,536

(22) Filed: Nov. 14, 2017

(65) Prior Publication Data

US 2018/0171807 A1 Jun. 21, 2018

(30) Foreign Application Priority Data

Dec. 21, 2016 (KR) ..... 10-2016-0175678

(51) Int. Cl.
*F01D 5/32* (2006.01)
*F01D 5/30* (2006.01)

(52) U.S. Cl.
CPC ..... *F01D 5/32* (2013.01); *F01D 5/3038* (2013.01); *F05D 2230/60* (2013.01); *F05D 2260/31* (2013.01)

(58) Field of Classification Search
CPC ... F01D 5/303; F01D 5/32; F01D 5/30; F01D 5/3023; F01D 5/3038; F04D 29/322; F04D 29/34; F05D 2260/30
See application file for complete search history.

(56) References Cited

U.S. PATENT DOCUMENTS 4,684,325 A 8/1987 Arnold
2005/0129522 A1* 6/2005 Kite ..... F01D 5/32 416/220 R (Continued)

FOREIGN PATENT DOCUMENTS

JP 2011-226475 A 11/2011
JP 2015-078689 A 4/2015

(Continued)

OTHER PUBLICATIONS

European Search Report dated May 7, 2018 in European Application No. 17203112.2-1006.

(Continued)

*Primary Examiner* — Dwayne J White
*Assistant Examiner* — Wesley Le Fisher
(74) *Attorney, Agent, or Firm* — Invenstone Patent, LLC

(57) ABSTRACT

A locking spacer, which is fitted in a dovetail slot provided on an outer circumferential surface of a disk put on a rotor shaft, includes: a pair of first blocks each provided with a dovetail joint and a stepped seating surface with a first bolt hole, and configured to have a size occupying a portion of an internal space of the dovetail slot; a second block having a size to be inserted into a remaining portion of the internal space of the dovetail slot, and having a height corresponding to the seating surfaces; a fixing plate seated on both the seating surfaces of the first blocks and an upper surface of the second block, and provided with second bolt holes corresponding to the first bolt holes; and a bolt screwed into the first bolt hole through an associated second bolt hole.

20 Claims, 10 Drawing Sheets

(56) References Cited

U.S. PATENT DOCUMENTS

| | | | | |
|---|---|---|---|---|
| 2005/0254950 | A1* | 11/2005 | Mons | F01D 5/06<br>416/201 R |
| 2009/0016889 | A1* | 1/2009 | Krutzfeldt | F01D 5/3038<br>416/204 R |
| 2011/0255978 | A1* | 10/2011 | Potter | F01D 5/3038<br>416/204 A |
| 2014/0127026 | A1* | 5/2014 | Farineau | F01D 5/3038<br>416/220 R |
| 2015/0101348 | A1 | 4/2015 | Hansen et al. | |
| 2015/0101349 | A1* | 4/2015 | Hansen | F01D 5/303<br>60/805 |
| 2015/0101350 | A1* | 4/2015 | Healy | F01D 5/303<br>60/805 |

FOREIGN PATENT DOCUMENTS

| | | | |
|---|---|---|---|
| KR | 10-2007-0009391 | A | 1/2007 |
| KR | 10-2014-0068077 | A | 6/2014 |

OTHER PUBLICATIONS

Office Action dated Dec. 20, 2017 in Korean Application No. 10-2016-0175678.

* cited by examiner

LOCKING SPACER FOR ROTOR BLADE

CROSS-REFERENCE TO RELATED APPLICATION

This application claims the benefit of Korean Patent Application Serial No. 10-2016-0175678, filed Dec. 21, 2016, the disclosure of which is hereby incorporated by reference in its entirety.

BACKGROUND OF THE DISCLOSURE

Field of the Disclosure

The present disclosure relates generally to a locking spacer for a rotor blade. More particularly, the present disclosure relates to a locking spacer that is finally fitted in a dovetail slot provided on an outer circumferential surface of a disk put on a rotor shaft in the process of alternate mounting of a blade and a spacer in the dovetail slot.

Description of the Background Art

Generally, a turbine is a mechanical device that obtains torque by impulsive force or reaction force using flow of compressible fluid such as steam or gas. It is called as a steam turbine when steam is used and a gas turbine when combustion gas is used.

A thermodynamic cycle of the gas turbine is the Brayton Cycle, and the gas turbine is constituted by a compressor, a combustor, and a turbine. The operation principle of the gas turbine comprises the following four steps: compression, heating, expansion, and heat dissipation. That is, the air in the atmosphere is sucked first, compressed by the compressor, then sent to the combustor to generate high temperature and high pressure gas to operate the turbine, and the exhaust gas is discharged to the atmosphere.

The compressor of the gas turbine serves to suck air from the atmosphere and supply combustion air to the combustor, and the combustion air is subjected to adiabatic compression process, so that the pressure and the temperature of the air are increased.

In the combustor, the compressed air is mixed with fuel and is burned under equal pressure to produce combustion gas of high energy, and to increase efficiency, the combustion gas temperature is increased to the heat resistance limit that the combustor and turbine components can withstand.

In the gas turbine, the combustion gas of high temperature and high pressure from the combustor is expanded, and it is converted into mechanical energy by applying the collision reaction force to rotating blades of the turbine. The mechanical energy obtained from the turbine is supplied to the compressor required to compress the air and the remainder is used to drive a generator to produce power.

Since the gas turbine has no reciprocating motion in major components, there is no mutual friction part like a piston-cylinder, whereby consumption of lubricating oil is extremely small, amplitude which is characteristic of reciprocating machine is greatly reduced, and high speed movement is possible.

In the turbine of the steam turbine and the turbine and the compressor of the gas turbine, a rotor shaft rotating at a high speed is supported by bearings, and a plurality of disks having holes in the centers thereof are inserted and fixed in the turbine shaft. A plurality of rotating blades is arranged along the outer circumferential surface of each disk. Turbine blades serve to convert high-temperature and high-pressure steam or combustion gas energy into rotary motion, while compressor blades serve to continuously pressurize the intake air.

FIGS. 1 to 4 are views showing a method of mounting a blade 30 along the outer circumferential surface of a disk 10. The method is that the blade 30 and a spacer 40 are alternately fitted in a dovetail slot 20 formed along the outer circumferential surface of the disk 10. A dovetail joint 50 having a shape complementary to the shape of the dovetail surface 25 is formed in the lower portion of the base of the blade 30 and in the spacer 40.

Referring to the assembly process in FIGS. 1 to 4, with the blade 30 or the dovetail joint 50 of the spacer 40 facing the circumferential direction of the dovetail slot 20, that is, with the dovetail joint 50 angled at 90 degrees with respect to opposite sides of the dovetail slot 20, the blade 30 and the spacer 40 are inserted into the dovetail slot 20, and in this state, the blade 30 and the spacer 40 are rotated at 90 degrees angle such that the dovetail joint 50 is fitted into the dovetail slot 20.

The dovetail joint 50 of the blade 30 and the spacer 40 with respect to the dovetail slot 20 has a slight clearance and gap in the radial direction so that the blade 30 and the spacer 40 can be rotated at 90 degrees angle in the dovetail slot 20, and a spring plate (not shown) is provided in a groove formed in the bottom surface of the dovetail slot 20 so as to push the blade 30 and the spacer 40 out of the radial direction to bring the dovetail joint 50 into contact with the dovetail slot 20. Since centrifugal force is applied on the blade 30 and the spacer 40 when the rotor shaft is rotated, the clearance and gap in the radial direction do not affect the operation of the turbine engine.

The blade 30 and the spacer 40 are assembled alternately in the dovetail slot 20 one by one. The last assembled spacer 40 cannot be engaged in the dovetail slot 20 by rotating it at 90 degrees angle in the dovetail slot 20 because the space remaining in the dovetail slot 20 is exactly the same as the size of the spacer 40. Accordingly, the last assembled spacer should have a specific structure that can be assembled without being rotated in the dovetail slot 20. For this reason, the last assembled spacer is called a locking spacer.

Basically, the locking spacer should be able to be engaged in the opposite sides of the dovetail slot without being rotated, and the assembly structure should be simple and robust and easy to disassemble for maintenance.

The foregoing is intended merely to aid in the understanding of the background of the present disclosure, and is not intended to mean that the present disclosure falls within the purview of the background art that is already known to those skilled in the art.

DOCUMENTS OF RELATED ART (Patent Document 1) Korean Patent Application publication No. 2007-0009391 (published Jan. 18, 2007)

(Patent Document 2) Korean Patent Application publication No. 2014-0068077 (published Jun. 5, 2014)

SUMMARY OF THE DISCLOSURE

Accordingly, the present invention has been made keeping in mind the above problems occurring in the related art, and the present disclosure provides a locking spacer, which is finally assembled with the dovetail slot of the disk, having a structure that is simple, robust, and easy to disassemble for maintenance.

According to some aspects of the present disclosure, there is provided a locking spacer, which is fitted in a dovetail slot provided on an outer circumferential surface of a disk put on a rotor shaft, the locking spacer including: a pair of first blocks each provided with a dovetail joint having a shape corresponding to a shape of a dovetail surface provided on each of axial opposite sides of the dovetail slot, and a stepped seating surface with a first bolt hole provided in an upper surface of the first block, and configured to have a size occupying a portion of an internal space of the dovetail slot; a second block having a size to be inserted into a remaining portion of the internal space of the dovetail slot, the remaining portion without being occupied by the pair of first blocks, and having a height corresponding to the seating surfaces of the first blocks; a fixing plate seated on both the seating surfaces of the first blocks and an upper surface of the second block, and provided with second bolt holes corresponding to the first bolt holes; and a bolt screwed into the first bolt hole through an associated second bolt hole.

Further, the second block may be provided with guide slots engaged with guide protrusions provided in the first blocks.

Herein, the guide protrusions and the guide slots are provided along radial directions of the first blocks and the second block.

Further, the guide protrusions and the guide slots may be provided on circumferential sides of the first blocks and the second block.

Further, each of the second bolt holes may be provided with a space for receiving a head of the bolt, and here, the bolt may be a hexagon socket bolt.

Further, at least one of sides in an axial direction of the fixing plate may be provided with a protrusion, and the upper surface of each of the pair of first blocks may be provided with a groove corresponding to the protrusion.

Further, a welding portion may be provided along an axial contact surface between the upper surfaces of the first blocks and the fixing plate.

Further, the first blocks and the second block may be made of a titanium material.

Further, the upper surfaces of the first blocks and an upper surface of the fixing plate may form one connected surface.

Meanwhile, an assembly method for a locking spacer according to the present disclosure, in which a blade and a spacer are alternately inserted into a dovetail slot provided on an outer circumferential surface of a disk put on a rotor, wherein the blade and the spacer are inserted into the dovetail slot in a state where dovetail joints of both the blade and the spacer are at an angle of 90 degrees to opposite sides of the dovetail slot, then the blade and the spacer are rotated at 90 degree angles, such that the dovetail joints are fitted in the dovetail slot, the blade and the spacer are assembled alternately into the dovetail slot one by one, and finally the locking spacer according to any one of embodiments described above is engaged in a remaining space of the dovetail slot, the assembly method including: engaging the dovetail joint of each of the pair of first blocks with a dovetail surface provided on each of axial opposite sides of the dovetail slot to be fitted thereinto; inserting the second block into the remaining portion of the internal space of the dovetail slot, the remaining portion without being occupied by the pair of first blocks; seating the fixing plate on both the seating surfaces of the first blocks and the upper surface of the second block; and screwing the bolt into the first bolt hole provided in each of the pair of first blocks through the associated second bolt hole provided in the fixing plate.

The locking spacer of the present disclosure configured as described above is advantageous in that since it is constituted by separate the first blocks and the second block, it is possible to insert the locking spacer directly into the last remaining space of the dovetail slot, and it is possible to easily assemble by fitting through the guide structure of the protrusion and the slot.

Further, it is possible to easily the locking spacer through a simple task of separating the bolt 140 and removing the welding portion by grinding when maintenance is needed.

Further, since the first blocks, the second block, and the like are made of a lightweight titanium material to reduce the centrifugal load, it is possible to reduce the tensile load acting on the bolt, whereby it is possible to secure the function of the locking spacer for a long time.

BRIEF DESCRIPTION OF THE DRAWINGS

The above and other features of the present disclosure will be more clearly understood from the following detailed description when taken in conjunction with the accompanying drawings, in which.

DETAILED DESCRIPTION OF THE DISCLOSURE

Figure 1:
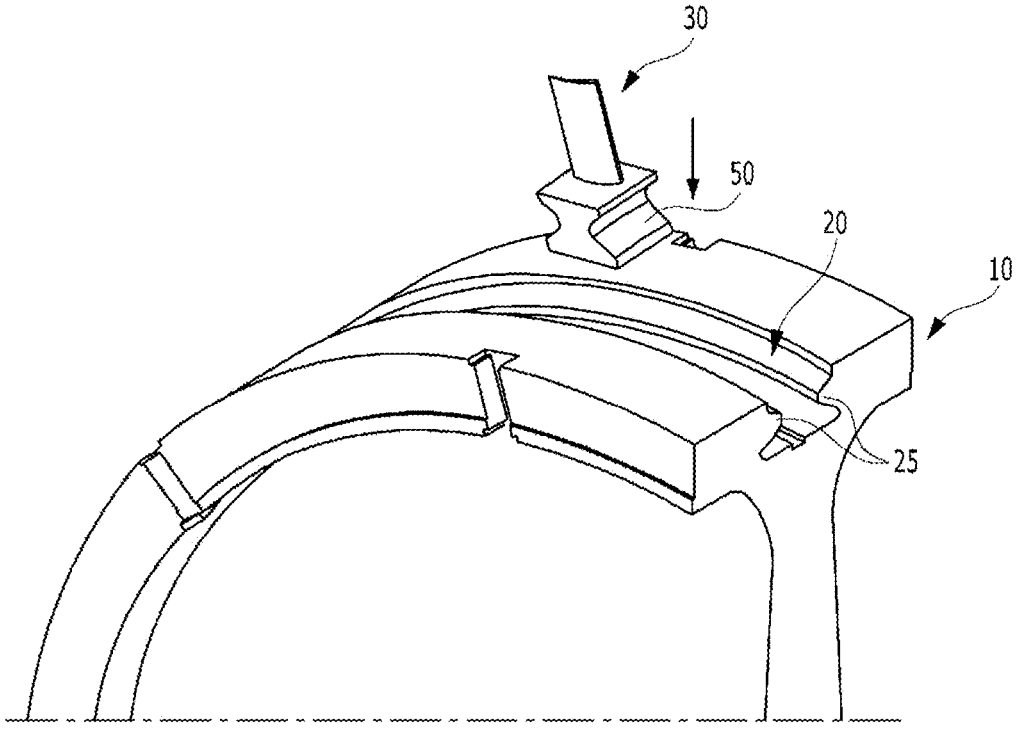
FIGS. 1 to 4 are views showing a process of alternate mounting of a blade and a spacer in a dovetail slot of a disk.
Figure 2:
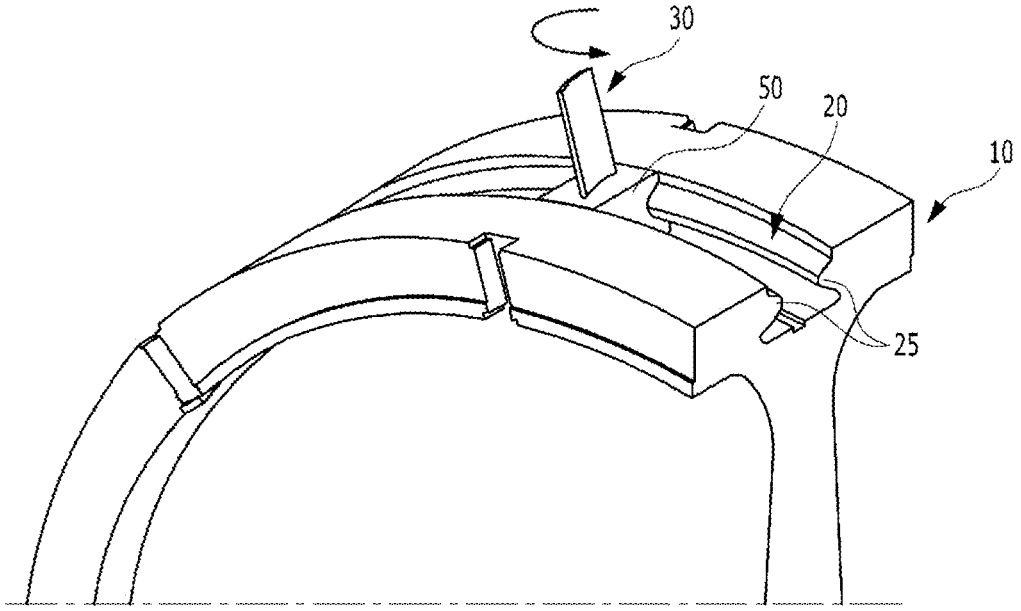
Figure 3:
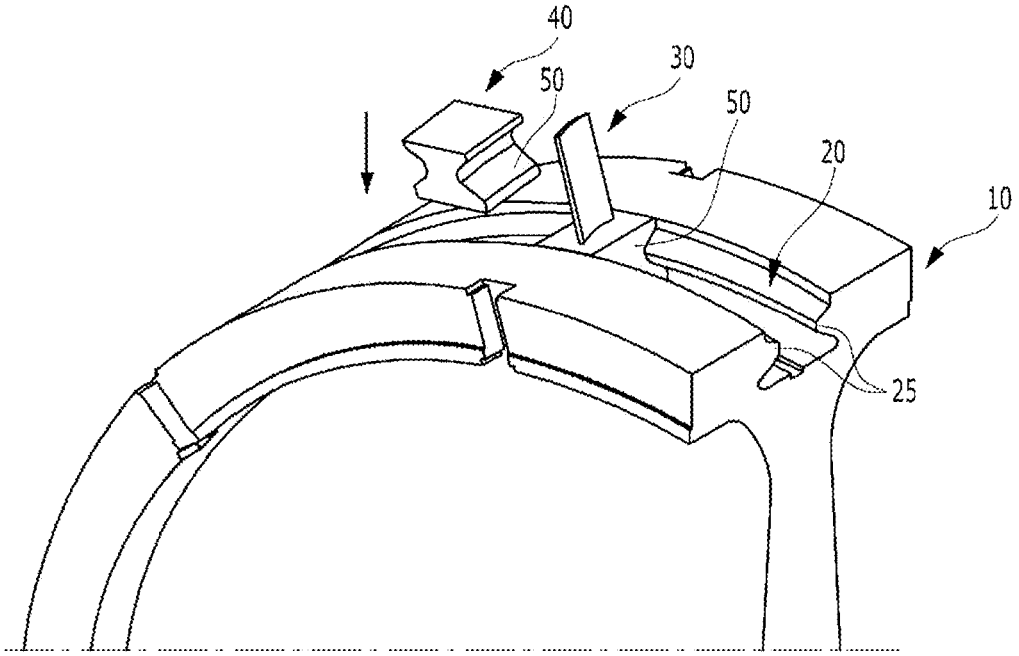
Figure 4:
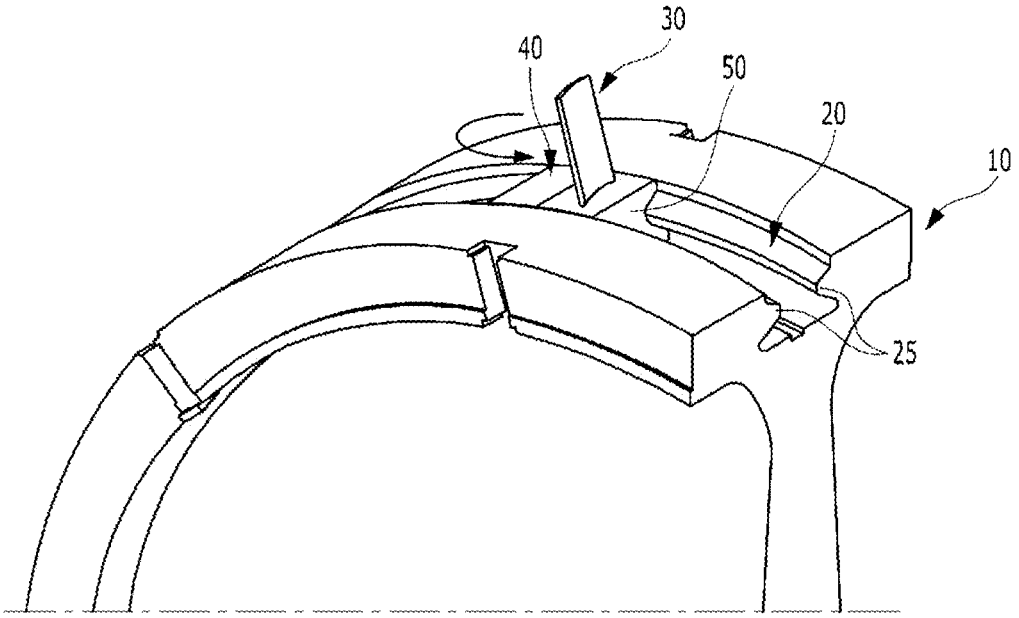

Reference will now be made in greater detail to a preferred embodiment of the disclosure, an example of which is illustrated in the accompanying drawings. Wherever possible, the same reference numerals will be used throughout the drawings and the description to refer to the same or like parts. In the following description, it is to be noted that, when the functions of conventional elements and the detailed description of elements related with the present disclosure may make the gist of the present disclosure unclear, a detailed description of those elements will be omitted.

Further, terms such as "a first ~", "a second ~", "A", "B", "(a)", and "(b)" are used only for the purpose for distinguishing a constitutive element from other constitutive element, but constitutive element should not be limited to a manufacturing order, and the terms described in the detailed description of the invention may not be consistent with those described in the claims. It will be understood that when an element is referred to as being "coupled" or "connected" to another element, it can be directly coupled or connected to the other element or intervening elements may be present therebetween.

Figure 5:
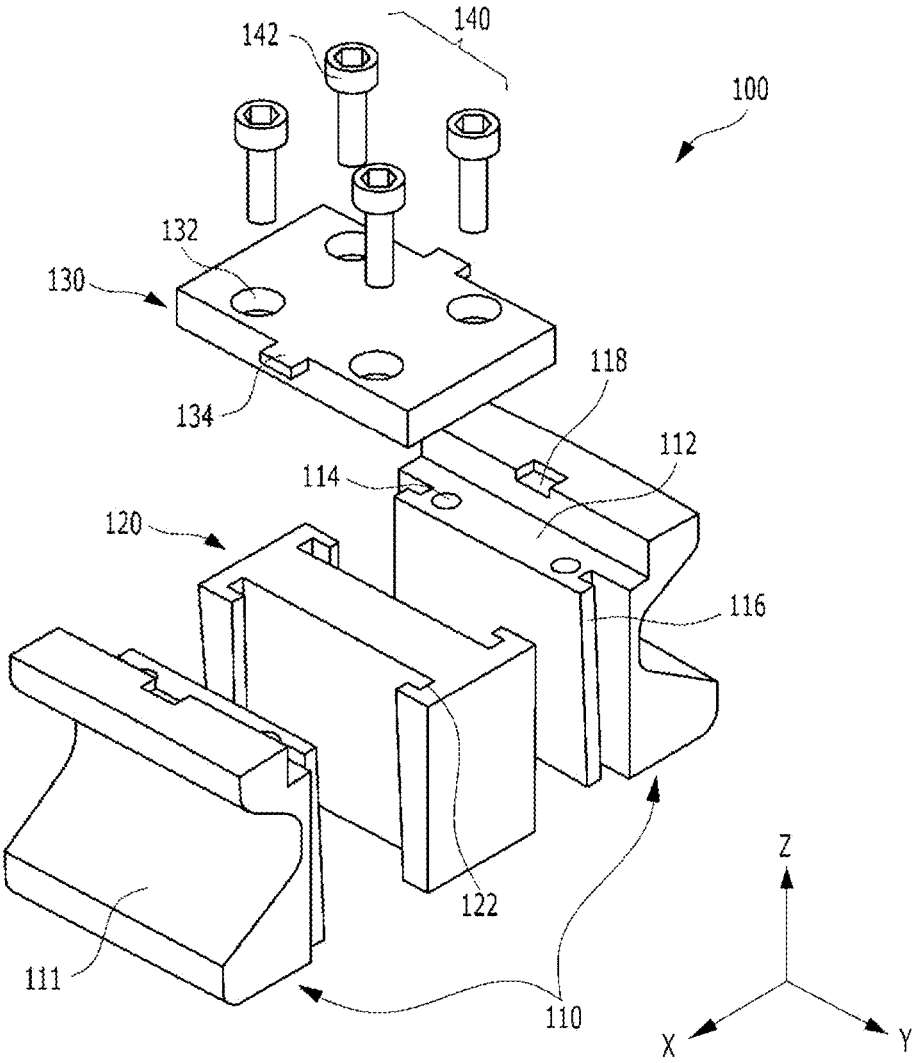
FIG. 5 is a detailed perspective view showing a structure of a locking spacer according to the present disclosure.

FIG. 5 is a detailed perspective view showing a structure of a locking spacer according to the present disclosure, and a detailed description will be made with reference to this. Herein, in describing the present disclosure, considering that a direction in which a locking spacer 100 is assembled into a dovetail slot 20 is determined in one direction, based on the direction in which the locking spacer 100 is mounted in the dovetail slot 20 formed along the outer circumferential surface of a disk 10, the directions of X, Y, and Z axes are referred to as an axial direction, a circumferential direction, and a radial direction, respectively.

The locking spacer 100 of the present disclosure is constituted by several separate parts, and the parts are assembled by being inserted directly into the last remaining space after all blades 30 and spacers 40 are assembled with a dovetail slot 20 through processes shown in FIGS. 1 to 4, thereby forming one locking spacer 100.

As shown in FIG. 5, the locking spacer 100 of the present disclosure includes: a pair of first blocks 110; one second block 120; a fixing plate 130; and a bolt 140.

The first blocks 110 are a pair of symmetrical blocks each provided with a dovetail joint 111 having a shape corresponding to a shape of a dovetail surface 25 formed on each axial direction X opposite sides of the annular dovetail slot 20 formed along the outer circumferential surface of the disk 10. Since the first block 110 is provided with the dovetail joint 111, it is a block that serves to couple the assembled locking spacer 100 to the dovetail slot 20.

The pair of first blocks 110 has a size occupying a part of the internal space of the dovetail slot 20 because the second block 120 needs a space to be inserted. In other words, when the pair of first blocks 110 are brought into contact with corresponding dovetail surface 25 of the dovetail slot 20, the middle portion of the dovetail slot 20 is empty, and the second block 120 is inserted in the middle space thereof.

Further, the upper surface of the first block 110 is provided with a stepped seating surface 112 having a first bolt hole 114. The first bolt hole 114 and the stepped seating surface 112 are the parts for coupling the fixing plate 130.

As described above, the second block 120 has a size to be inserted into the interior space of the dovetail slot 20 which is not occupied by the pair of first blocks 110. Further, the second block 120 has a height corresponding to the seating surfaces 112 of the first blocks 110 such that the periphery of the upper surface of the second block 120 is flat when the second block 120 is interposed between the pair of first blocks 110. In other words, the seating surfaces 112 of the first blocks 110 and the upper surface of the second block 120 form a flat surface, and the fixing plate 130 is seated on the flat surface.

The fixing plate 130 is a part for firmly coupling the pair of first blocks 110 and the second block 120 interposed therebetween. The fixing plate 130 is seated on the seating surfaces 112 of the first blocks 110 and the upper surface of the second block 120, and is provided with second bolt holes 132 corresponding to the first bolt holes 114 formed in the seating surfaces 112 of the first blocks 110. The number of the first and second bolt holes 114 and 132 may be appropriately selected in consideration of the coupling strength, and in the embodiment, four first bolt holes 114 and four second bolt holes 132 are provided.

Further, a bolt 140 is screwed into each first bolt hole 114 of the first blocks 110 through an associated second bolt hole of the fixing plate 130.

Meanwhile, the first block 110 may be provided with guide protrusions 116, and the second block 120 may be provided with guide slots 122 engaged with the guide protrusions 116 provided on the first block 110. The guide protrusions 116 and the guide slots 122 corresponding thereto are parts for inducing the first blocks 110 and the second block 120 to be inserted into the desired position.

Herein, the guide protrusions 116 and the guide slots 122 are formed along radial directions Z of the first block 110 and the second block 120, respectively. This is to fit the pair of first blocks 110 into the dovetail surfaces 25 of the dovetail slot 20 and push the second block 120 into the space therebetween.

In the embodiment the guide protrusions 116 and the guide slots 122 are formed on circumferential direction Y sides of the first block 110 and the second block 120. This is advantageous in that the guide protrusions 116 and the guide slots 122 have the strongest coupling force when fitted together at outermost ends thereof.

Further, each of the second bolt holes 132 may be formed with a step for receiving a head 142 of the bolt 140. It is because if the bolt head 142 protrudes, it may disturb the normal flow of the fluid acting on the blade 30. Here, it is preferred that the bolt 140 with the bolt head 142 inserted into the second bolt holes 132 be a hexagon socket bolt with excellent strength compared to the size.

Further, for the same reason as mentioned above, it is preferred that the upper surfaces of the first blocks 110 and the upper surface of the fixing plate 130 form one smoothly connected surface.

Further, depending on the embodiment, a protrusion 134 may be formed on at least one side of the fixing plate 130 in the axial direction X to precisely hold the mounting position of the fixing plate 130 before fixing the bolt 140, and correspondingly, a groove 118 may be formed in the upper surface of the pair of first blocks 110 to receive the protrusion 134.

If the mounting direction of the fixing plate 130 is to be determined in one direction according to the embodiment, the protrusion 134 of the fixing plate 130 may be used to limit the mounting direction in one direction. For example, it is possible to form the protrusion 134 on only one side of the fixing plate 130 or to assemble in only one direction by making the position of the protrusion 134 asymmetrical.

FIGS. 6 to 10 are views showing a process of finally mounting of the locking spacer 100 in the dovetail slot 20 of the disk 10.

Figure 6:
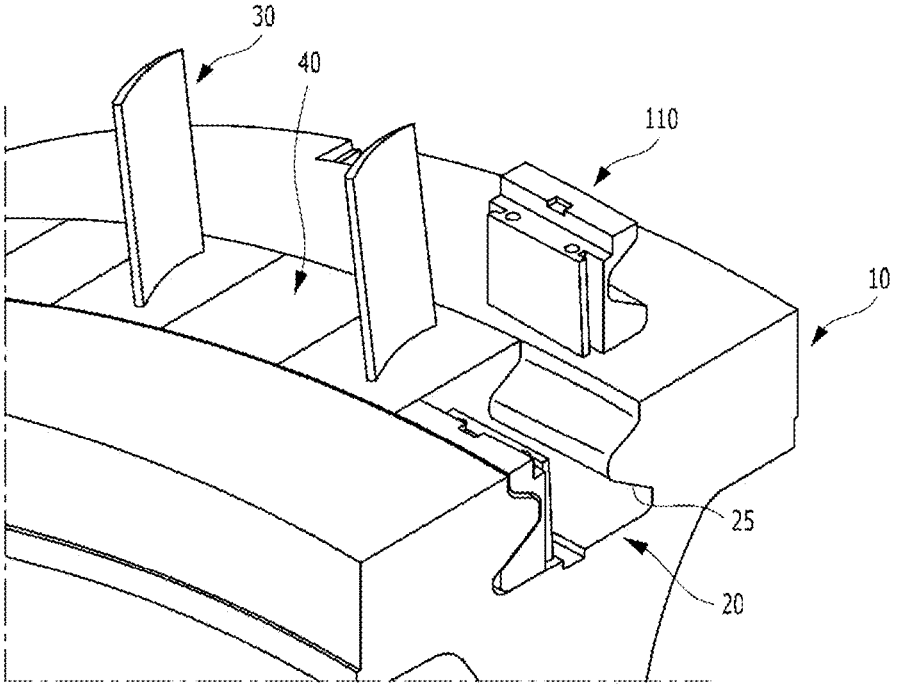
FIGS. 6 to 10 are views showing a process of mounting of the locking spacer of FIG. 5 in the dovetail slot of the disk.
Figure 7:
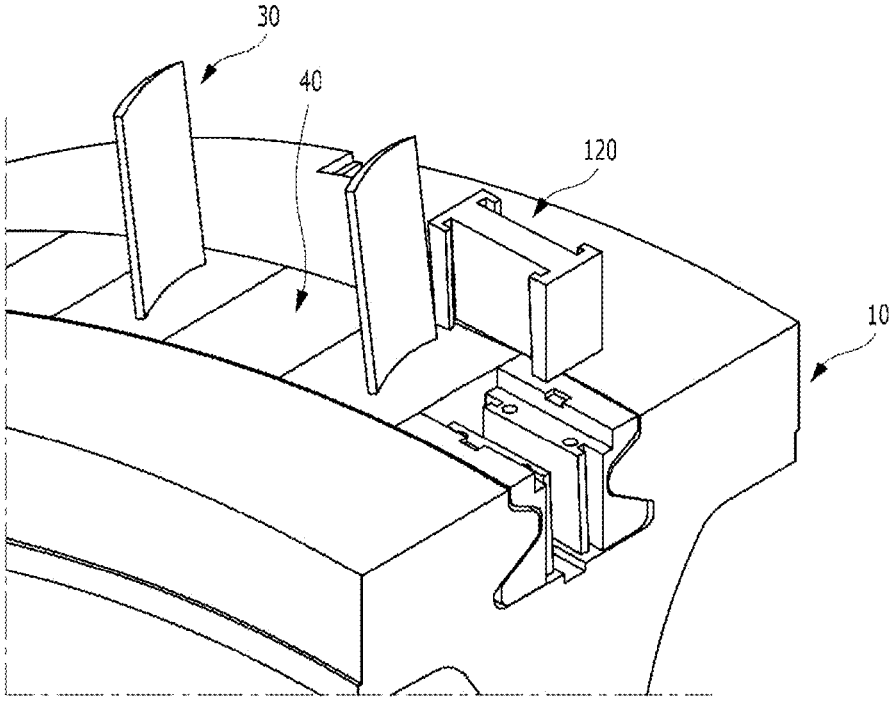
Figure 8:
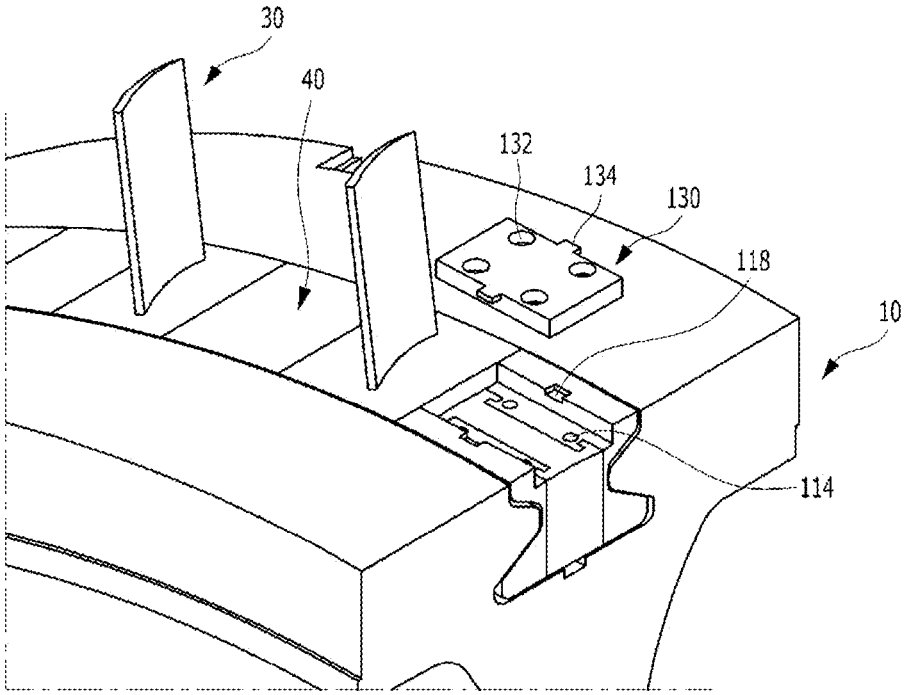

Firstly, two first blocks 110 are fitted into the dovetail slot 20 (see FIG. 6). When the first blocks 110 are engaged with opposite sides of the dovetail slot 20, a space is defined therebetween, and the guide slots 122 of the second block 120 are aligned with the guide protrusions 116 of the first blocks 110 and directly pushed in the radial direction Z (see FIG. 7).

Figure 9:
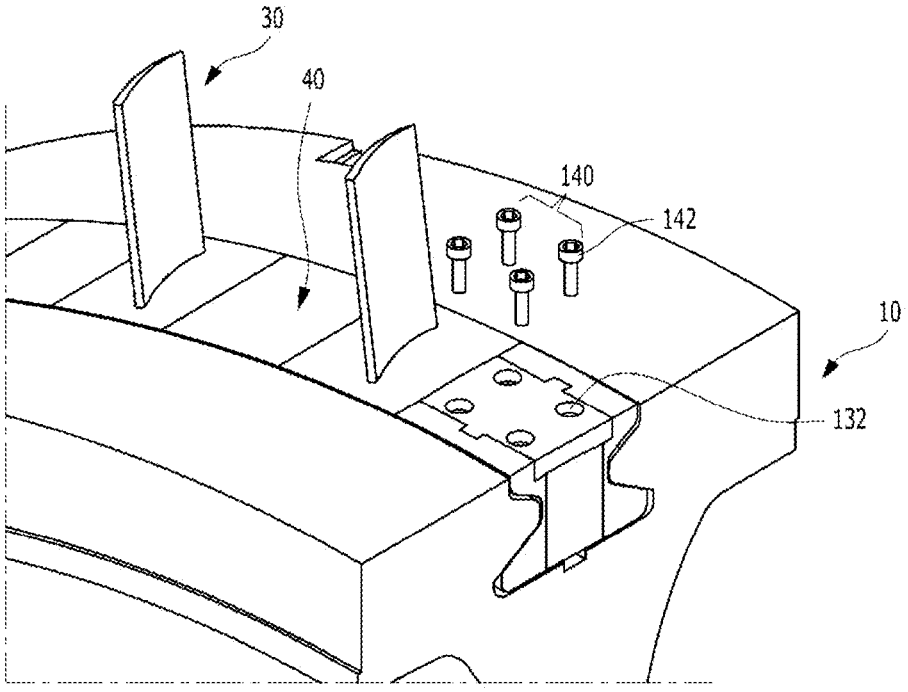

When the first blocks 110 and the second block 120 are installed in the above process, the protrusion 134 of the fixing plate 130 is aligned with the groove 118 of the first block 110 (see FIG. 8), and then, the bolt 140 is screwed into the first bolt hole 114 of the first block 110 through the second bolt hole 132 of the fixing plate 130 (see FIG. 9).

Figure 10:
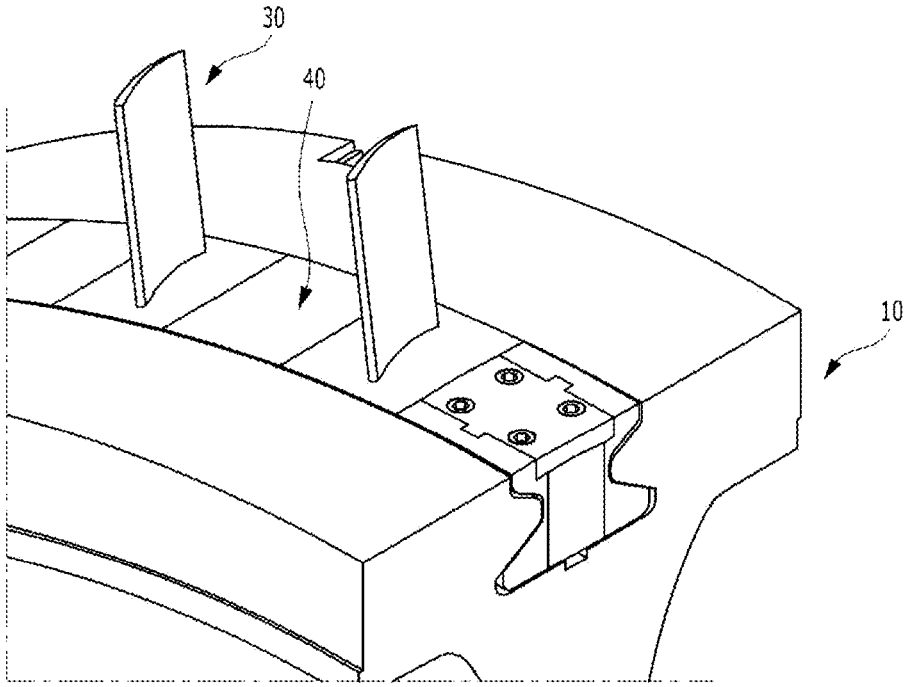

Here, when a space for accommodating the bolt head 142 is formed in the second bolt hole 132, as shown in FIG. 10, the bolt head 142 is embedded in the fixing plate 130 to form a smooth surface. If necessary, the hexagonal socket of the hexagon socket bolt 140 may be filled with a suitable heat-resistant filler material to further reduce the effect on the airflow around the blade 30.

Through the above process, the locking spacer 100 of the present disclosure can be easily assembled into the dovetail slot 20 of the disk 10.

Herein, to further secure the assembled state of the locking spacer 100, a welding portion may be formed by welding along an axial direction X contact surface between the upper surfaces of the first blocks 110 and the fixing plate 130. Welding is not a problem as it can be easily replaced with a simple task of separating the bolt 140 and removing the welding portion by grinding when maintenance is needed.

Further, each component including at least the first blocks 110 and the second block 120 (relatively large components)

may be made of a titanium material. The metals of titanium (including titanium alloys) are fairly lightweight, which reduces the centrifugal load applied when the rotor rotates at a high speed, whereby by reducing the tensile load acting on the bolt 140, the function of the locking spacer 100 can be maintained stably for a long time.

The present invention is not necessarily limited to these embodiments, as all of the components constituting the embodiment of the present invention have been described as being combined or operated as a single unit. That is, within the scope of the present invention, all of the components may operate selectively in combination with one or more. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof. Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

What is claimed is:

1. A locking spacer, which is fitted in a dovetail slot provided on an outer circumferential surface of a disk put on a rotor shaft, the locking spacer comprising:

a pair of first blocks each provided with a dovetail joint having a shape corresponding to a shape of a dovetail surface provided on each of axial opposite sides of the dovetail slot, and a stepped seating surface with a first bolt hole provided in an upper surface of the first block, and configured to have a size occupying a portion of an internal space of the dovetail slot;

a second block having a size to be inserted into a remaining portion of the internal space of the dovetail slot, the remaining portion without being occupied by the pair of first blocks, and having a height corresponding to the seating surfaces of the first blocks:

a fixing plate seated on both the stepped seating surfaces of the first blocks and an upper surface of the second block, and provided with second bolt holes corresponding to the first bolt holes; and a bolt screwed into the first bolt hole through an associated second bolt hole.

2. The locking spacer of claim 1, wherein the second block is provided with guide slots engaged with guide protrusions provided on the first blocks.

3. The locking spacer of claim 2, wherein the guide protrusions and the guide slots are provided along radial directions of the first blocks and the second block.

4. The locking spacer of claim 3, wherein the guide protrusions and the guide slots are provided on circumferential sides of the first blocks and the second block.

5. The locking spacer of claim 1, wherein each of the second bolt holes is provided with a space for receiving a head of the bolt.

6. The locking spacer of claim 5, wherein the bolt is a hexagon socket bolt.

7. The locking spacer of claim 1, wherein at least one side in an axial direction of the fixing plate is provided with a protrusion, and the upper surface of each of the pair of first blocks is provided with a groove corresponding to the protrusion.

8. The locking spacer of claim 1, wherein a welding portion is provided along an axial contact surface between the upper surfaces of the first blocks and the fixing plate.

9. The locking spacer of claim 1, wherein the first blocks and the second block are made of a titanium material.

10. The locking spacer of claim 1, wherein the upper surfaces of the first blocks and an upper surface of the fixing plate form one connected surface.

11. A blade disk assembly configured such that a blade and a spacer are alternately inserted into a dovetail slot provided on an outer circumferential surface of a disk put on a rotor, wherein the blade and the spacer are inserted into the dovetail slot in a state where dovetail joints of both the blade and the spacer are at an angle of 90 degrees to opposite sides of the dovetail slot, and then the blade and the spacer are rotated 90 degrees, such that the dovetail joints are fitted in the dovetail slot, wherein the blade and the spacer are assembled alternately into the dovetail slot one by one, and finally a locking spacer for a rotor blade is engaged in a remaining space of the dovetail slot, and the locking spacer for a rotor blade includes:

a pair of first blocks each provided with a dovetail joint having a shape corresponding to a shape of a dovetail surface provided on each of axial opposite sides of the dovetail slot, and a stepped seating surface with a first bolt hole provided in an upper surface of the first block, and configured to have a size occupying a portion of an internal space of the dovetail slot;

a second block having a size to be inserted into a remaining portion of the internal space of the dovetail slot, the remaining portion without being occupied by the pair of first blocks, and having a height corresponding to the seating surfaces of the first blocks;

a fixing plate seated on both the stepped seating surfaces of the first blocks and an upper surface of the second block, and provided with second bolt holes corresponding to the first bolt holes; and a bolt screwed into the first bolt hole through an associated second bolt hole.

12. The blade disk assembly of claim 11, wherein the second block is provided with guide slots engaged with guide protrusions provided on the first blocks.

13. The blade disk assembly of claim 12, wherein the guide protrusions and the guide slots are provided along radial directions of the first blocks and the second block.

14. The blade disk assembly of claim 13, wherein the guide protrusions and the guide slots are provided on circumferential sides of the first blocks and the second block.

15. The blade disk assembly of claim 11, wherein each of the second bolt holes is provided with a space for receiving a head of the bolt.

16. The blade disk assembly of claim 11, wherein at least one side in an axial direction of the fixing plate is provided with a protrusion, and the upper surface of each of the pair of first blocks is provided with a groove corresponding to the protrusion.

17. The blade disk assembly of claim 11, wherein a welding portion is provided along an axial contact surface between the upper surfaces of the first blocks and the fixing plate.

18. The blade disk assembly of claim 11, wherein the upper surfaces of the first blocks and an upper surface of the fixing plate form one connected surface.

19. An assembly method for a locking spacer, in which a blade and a spacer are alternately inserted into a dovetail slot provided on an outer circumferential surface of a disk put on a rotor, wherein the blade and the spacer are inserted into the dovetail slot in a state where dovetail joints of both the blade and the spacer are at an angle of 90 degrees to opposite sides of the dovetail slot, then the blade and the spacer are rotated 90 degrees, such that the dovetail joints are fitted in the dovetail slot, the blade and the spacer are assembled alternately into the dovetail slot one by one, and finally the locking spacer is engaged in a remaining space of the dovetail slot, the assembly method comprising:

engaging a dovetail joint of each of a pair of first blocks of the locking spacer with a dovetail surface provided on each of axial opposite sides of the dovetail slot to be fitted thereinto, a stepped seating surface with a first bolt hole being provided in an upper surface of the first block;

inserting a second block of the locking spacer into a remaining portion of an internal space of the dovetail slot, the remaining portion without being occupied by the pair of first blocks:

seating a fixing plate of the locking spacer on both the stepped seating surfaces of the first blocks and an upper surface of the second block, the second block having a height corresponding to the stepped seating surfaces of the first blocks; and screwing a bolt into the first bolt hole provided in each of the pair of first blocks through an associated second bolt hole provided in the fixing plate.

20. The assembly method of claim 19, wherein insertion of the pair of first blocks and the second block is performed along a radial direction of the disk without rotating the same.

* * * * *